US010072218B2

(12) United States Patent
Chen et al.

(10) Patent No.: US 10,072,218 B2
(45) Date of Patent: Sep. 11, 2018

(54) PYROLYSIS TAR CONVERSION

(71) Applicant: ExxonMobil Chemical Patents Inc., Baytown, TX (US)

(72) Inventors: Zezhou Chen, Beijing (CN); Zhenyu Liu, Beijing (CN); Qingya Liu, Beijing (CN); Lei Shi, Beijing (CN); Teng Xu, Houston, TX (US)

(73) Assignee: Exxon Mobil Chemical Patents Inc., Baytown, TX (US)

( * ) Notice: Subject to any disclaimer, the term of this patent is extended or adjusted under 35 U.S.C. 154(b) by 0 days.

(21) Appl. No.: 15/829,034

(22) Filed: Dec. 1, 2017

(65) Prior Publication Data

US 2018/0171239 A1 Jun. 21, 2018

Related U.S. Application Data

(60) Provisional application No. 62/435,238, filed on Dec. 16, 2016.

(51) Int. Cl.

| | |
|---|---|
| ***C10G 45/72*** | (2006.01) |
| ***C10G 75/00*** | (2006.01) |
| ***C10G 47/36*** | (2006.01) |

(52) U.S. Cl.

CPC ..... *C10G 45/72* (2013.01); *C10G 47/36* (2013.01); *C10G 75/00* (2013.01); *C10G 2300/201* (2013.01)

(58) Field of Classification Search

CPC .. C10G 2300/201; C10G 45/72; C10G 47/36; C10G 75/00; C10G 9/00; C10G 9/005; C10G 47/00; C10G 69/00; B01D 19/0036; B01D 3/06; B01D 5/003; B01D 5/0069

See application file for complete search history.

(56) References Cited

U.S. PATENT DOCUMENTS

| | | | | |
|---|---|---|---|---|
| 5,871,634 | A | 2/1999 | Wiehe et al. | |
| 8,083,931 | B2 | 12/2011 | McCoy et al. | |
| 9,637,694 | B2 * | 5/2017 | Evans | C10G 9/36 |
| 9,777,227 | B2 * | 10/2017 | Soultanidis | C10G 49/00 |
| 2015/0315496 | A1 | 11/2015 | Soultanidis et al. | |
| 2015/0368570 | A1 | 12/2015 | Beech, Jr. et al. | |
| 2016/0122667 | A1 | 5/2016 | Evans et al. | |

FOREIGN PATENT DOCUMENTS

| | | | |
|---|---|---|---|
| WO | 2013/033580 | A | 3/2013 |
| WO | 2013/033582 | A | 3/2013 |
| WO | 2013/033590 | A | 3/2013 |

* cited by examiner

*Primary Examiner* — Sharon Pregler

(57) ABSTRACT

A process is provided for determining the suitability of pyrolysis tar, such as steam cracker tar, for upgrading using hydroprocessing without long term fouling of the hydroprocessing reactor. The process includes heating a sample of the tar, quenching the sample, and measuring the total free radical content of the quenched sample. A pyrolysis tar can be blended with one having a lesser total free radical content to produce a blend that can be hydroprocessed with decreased fouling.

25 Claims, 4 Drawing Sheets

PYROLYSIS TAR CONVERSION

PRIORITY CLAIM

This application claim priority to and the benefit of U.S. Patent Application Ser. No. 62/435,238, filed Dec. 16, 2016, which is incorporated by reference in its entirety.

RELATED APPLICATIONS

This application is related to the following applications: U.S. Patent Application Ser. No. 62/525,345, filed Jun. 27, 2017; PCT Patent Application No. PCT/US17/64,117, filed Dec. 1, 2017; U.S. Patent Application Ser. No. 62/561,478, filed Sep. 21, 2017; PCT Patent Application No. PCT/US17/64,128, filed Dec. 1, 2017; U.S. Patent Application Ser. No. 62/571,829, filed Oct. 13, 2017; PCT Patent Application No. PCT/US17/64,140, filed Dec. 1, 2017; PCT Patent Application No. PCT/US17/64,165, filed Dec. 1, 2017; PCT Patent Application No. PCT/US17/64,176, filed Dec. 1, 2017, which are incorporated by reference in their entireties.

FIELD

This invention relates to a process for determining the suitability of pyrolysis tar, such as steam cracker tar, for upgrading using hydroprocessing without excessive fouling of the hydroprocessing reactor. The invention includes heating a sample of the pyrolysis tar to an elevated temperature, quenching the pyrolysis tar, and then measuring the quenched pyrolysis tar's total free radical content.

BACKGROUND

Pyrolysis processes, such as steam cracking, are utilized for converting saturated hydrocarbons to higher-value products such as light olefins, e.g., ethylene and propylene. Besides these useful products, hydrocarbon pyrolysis can also produce a significant amount of relatively low-value heavy products, such as pyrolysis tar. When the pyrolysis is conducted by steam cracking, the pyrolysis tar is identified as steam-cracker tar ("SCT").

Pyrolysis tar is a high-boiling, viscous, reactive material comprising complex, ringed and branched molecules that can polymerize and foul equipment. Pyrolysis tar also contains high molecular weight non-volatile components including paraffin insoluble compounds, such as pentane-insoluble compounds and heptane-insoluble compounds. Particularly challenging pyrolysis tars contain >1 wt. % toluene insoluble compounds. The toluene insoluble components are high molecular weight compounds, typically multi-ring structures that are also referred to as tar heavies ("TH"). These high molecular weight molecules can be generated during the pyrolysis process, and their high molecular weight leads to high viscosity, which makes the tar difficult to process and transport.

Blending pyrolysis tar with lower viscosity hydrocarbons has been proposed for improved processing and transport of pyrolysis tar. However, when blending heavy hydrocarbons, fouling of processing and transport facilities can occur as a result of precipitation of high molecular weight molecules, such as asphaltenes. See, e.g., U.S. Pat. No. 5,871,634, which is incorporated herein by reference in its entirety. In order to mitigate asphaltene precipitation, an Insolubility Number, $I_N$, and a Solvent Blend Number, $S_{BN}$, (determined for each blend component) can be used to guide the blending process. Successful blending is accomplished with little or substantially no precipitation by combining the components in order of decreasing $S_{BN}$, so that the $S_{BN}$ of the blend is greater than the $I_N$ of any component of the blend. Pyrolysis tars generally have high $S_{BN}$>135 and high $I_N$>80 making them difficult to blend with other heavy hydrocarbons. Pyrolysis tars having $I_N$>100, e.g., >110, e.g., >130, are particularly difficult to blend without phase separation occurring.

Attempts at pyrolysis tar hydroprocessing to reduce viscosity and improve both $I_N$ and $S_{BN}$ have not led to a commercializable process, primarily because fouling of process equipment could not be sufficiently mitigated. For example, hydroprocessing of neat SCT results in rapid catalyst deactivation when the hydroprocessing is carried out at a temperature in the range of about 250° C. to 380° C., a pressure in the range of about 5400 kPa to 20,500 kPa, using a conventional hydroprocessing catalyst containing one or more of Co, Ni, or Mo. This deactivation has been attributed to the presence of TH in the SCT, which leads to the formation of undesirable deposits (e.g., coke deposits) on the hydroprocessing catalyst and the reactor internals. As the amount of these deposits increases, the yield of the desired upgraded pyrolysis tar (e.g., upgraded SCT) decreases and the yield of undesirable byproducts increases. The hydroprocessing reactor pressure drop also increases, often to a point where the reactor is inoperable.

One approach taken to overcome these difficulties is disclosed in International Publication No. WO 2013/033580, which is incorporated herein by reference in its entirety. The reference discloses hydroprocessing SCT in the presence of a utility fluid comprising a significant amount of single and multi-ring aromatics to form an upgraded pyrolysis tar product. The upgraded pyrolysis tar product generally has a decreased viscosity, decreased atmospheric boiling point range, and increased hydrogen content over that of the pyrolysis tar feedstock, resulting in improved compatibility with fuel oil and other common blend-stocks. Additionally, efficiency advances involving recycling a portion of the upgraded pyrolysis tar product as utility fluid are described in International Publication No. WO 2013/033590 also incorporated herein by reference in its entirety.

Another improvement, disclosed in U.S. Publication No. 2015/0315496, which is incorporated herein by reference in its entirety, includes separating and recycling a mid-cut utility fluid from the upgraded pyrolysis tar product. The utility fluid comprises ≥10.0 wt. % aromatic and non-aromatic ring compounds and each of the following: (a) ≥1.0 wt. % of 1.0 ring class compounds; (b) ≥5.0 wt. % of 1.5 ring class compounds; (c) ≥5.0 wt. % of 2.0 ring class compounds; and (d) ≥0.1 wt. % of 5.0 ring class compounds.

U.S. Publication No. 2015/0368570, which is incorporated herein by reference in its entirety, describes separating and recycling a utility fluid from the upgraded pyrolysis tar product. The utility fluid contains 1-ring and/or 2-ring aromatics and has a final boiling point ≤430° C.

U.S. Publication No. 2016/0122667, which is incorporated herein by reference in its entirety, describes a process for upgrading pyrolysis tar, such as steam cracker tar, in the presence of a utility fluid which contains 2-ring and/or 3-ring aromatics and has solubility blending number ($S_{BN}$)≥120.

Despite these advances, there remains a need for further improvements in the hydroprocessing of pyrolysis tars, especially those having high $I_N$ values, which allow the production of upgraded tar product having lower viscosity at appreciable hydroprocessing reactor run lengths.

SUMMARY

When hydroprocessing pyrolysis tars, especially those having an incompatibility number ($I_N$)>110, it has been discovered that using a pyrolysis tar having a desired radical content profile, e.g., as measured by electron spin resonance ("ESR") measurements, beneficially reduces reactor fouling. More particularly, it has been found that for a wide range of desirable pyrolysis tar hydroprocessing conditions, a reference free radical content $R_{ref}$ can be specified for comparison with a total free radical content $R_T$ of a suitably-prepared pyrolysis tar sample. The invention is based in part on the discovery that when $R_T$ does not exceed $R_{ref}$, the pyrolysis tar can be hydroprocessed with decreased reactor fouling and increased run-lengths. Advantageously, $R_T$ can be determined using the suitably prepared pyrolysis tar sample at ambient (e.g., 25° C.) temperature, the sample being obtained from a pyrolysis tar provided at a temperature $T_1 \leq 350°$ C. The sample is prepared by exposing the sample to a predetermined temperature $T_2$ for a predetermined time $t_h$, where $T_2$ is $\geq T_1+10°$ C. This has been found to increase the pyrolysis tar's free radical content. Next, the heated sample is cooled by exposing the sample to a temperature $T_3$ that is $\leq T_1$. The cooled sample's total free radical content $R_T$ is measured, and compared to $R_{ref}$. If $R_T$ exceeds $R_{ref}$, the pyrolysis tar may be mixed with a second pyrolysis tar (particularly one of lesser $R_T$) to achieve the desired radical content profile in a suitably-prepared sample of the pyrolysis tar blend, e.g., a blend sample $R_T$ that does not exceed $R_{re}$f. Preparation of the blend sample for measurement of $R_T$ can follow substantially the same procedure as preparation of the original sample. Alternatively, when the radical content of the pyrolysis tar fails to meet the desired profile, e.g., $R_T$ exceeds $R_{ref}$, then reactor fouling is indicated, and the pyrolysis tar's radical profile may be used to select hydroprocessing parameters which reduce the risk of reactor fouling.

BRIEF DESCRIPTION OF THE DRAWINGS

The drawings are for illustrative purposes only and are not intended to limit the scope of the present invention.

DETAILED DESCRIPTION

Figure 1:
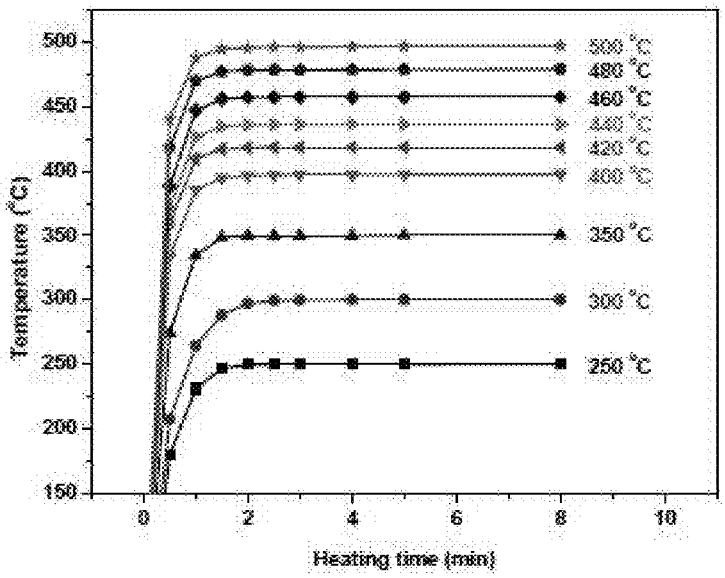
FIG. 1 is a graph of sample temperatures measured over time.

A pyrolysis tar at a temperature $T_1 \leq 350°$ C. is evaluated for its potential for fouling the reactor at desired hydroprocessing conditions. The evaluation is undertaken by sampling the pyrolysis tar, raising the temperature of the sample to a predetermined temperature $T_2$ that is at least 10° C. greater than $T_1$, for predetermined period of time $t_h$. Typically, $T_2$ is substantially the same as the desired hydroprocessing temperature, and $t_h$ is substantially the same as the time during which the tar is exposed to hydroprocessing conditions. Following this, the sample is cooled to a temperature $T_3 \leq T_1$, and the total radical content $R_T$ of the cooled sample is measured, e.g., using ESR. If $R_T$ exceeds $R_{ref}$, the pyrolysis tar may be blended with a second pyrolysis tar to reduce the free radical content of the blended tar for hydroprocessing. Alternatively, the hydroprocessing conditions can be adjusted to reduce the severity of the reaction and/or to slow the reaction, to reduce the potential for fouling of the hydroprocessing. A plurality of pyrolysis tars, including a plurality of SCTs, may be blended prior to hydroprocessing to produce a blended pyrolysis tar with a specific free radical profile, e.g., one exhibiting a blended sample $R_T \leq R_{ref}$. Further, the SCTs or pyrolysis tars may be combined with a utility fluid for hydroprocessing.

The following terms are defined for this description and appended claims.

The term "pyrolysis tar" means (a) a mixture of hydrocarbons having one or more aromatic components and optionally (b) non-aromatic and/or non-hydrocarbon molecules, the mixture being derived from hydrocarbon pyrolysis, with at least 70% of the mixture having a boiling point at atmospheric pressure that is ≥about 550° F. (290° C.). Certain pyrolysis tars have an initial boiling point ≥200° C. For certain pyrolysis tars, ≥90.0 wt. % of the pyrolysis tar has a boiling point at atmospheric pressure ≥550° F. (290° C.). Pyrolysis tar can comprise, e.g., ≥50.0 wt. %, e.g., ≥75.0 wt. %, such as ≥90.0 wt. %, based on the weight of the pyrolysis tar, of hydrocarbon molecules (including mixtures and aggregates thereof) having (i) one or more aromatic components, and (ii) a number of carbon atoms ≥about 15. Pyrolysis tar generally has a metals content, $\leq 1.0 \times 10^3$ ppmw, based on the weight of the pyrolysis tar, which is an amount of metals that is far less than that found in crude oil (or crude oil components) of the same average viscosity. "SCT" means pyrolysis tar obtained from steam cracking.

"Tar Heavies" (TH) are a product of hydrocarbon pyrolysis having an atmospheric boiling point ≥565° C. and comprising ≥5.0 wt. % of molecules having a plurality of aromatic cores based on the weight of the product. The TH are typically solid at 25° C. and generally include the fraction of SCT that is not soluble in a 5:1 (vol.:vol.) ratio of n-pentane:SCT at 25° C. TH generally includes asphaltenes and other high molecular weight molecules.

Aspects of the invention include (i) establishing an $R_{ref}$ for desired hydroprocessing conditions, (ii) obtaining a sample of a pyrolysis tar, (iii) measuring $R_T$ of a suitably-prepared sample of the pyrolysis tar, and (iv) comparing $R_T$ to $R_{ref}$ to determine whether the pyrolysis tar will have a tendency to foul a hydroprocessing reactor operating under the desired hydroprocessing conditions. Further aspects induce methods for blending pyrolysis tars to achieve a desired radical profile, which is indicated when a suitably-prepared sample of the blend has an $R_T$ that does not exceed $R_{ref}$. Further aspects of the invention include selecting hydroprocessing parameters when $R_T$ of the suitably-prepared pyrolysis tar or pyrolysis tar blend exceeds $R_{ref}$. The invention is not limited to these aspects, and this description is not meant to foreclose other aspects within the broader scope of the invention.

Production of Pyrolysis Tar

Pyrolysis tars are a by-product of a pyrolysis process. Pyrolysis tar can be produced by exposing a hydrocarbon-containing feed to pyrolysis conditions in order to produce a pyrolysis effluent, the pyrolysis effluent being a mixture comprising unreacted feed, unsaturated hydrocarbon produced from the feed during the pyrolysis, and pyrolysis tar. For example, when a feed comprising ≥10.0 wt. % hydrocarbon, based on the weight of the feed, is subjected to pyrolysis, the pyrolysis effluent generally contains pyrolysis tar and ≥1.0 wt. % of $C_2$ unsaturates, based on the weight of the pyrolysis effluent. The pyrolysis tar typically comprises ≥90 wt. %, of the pyrolysis effluent's molecules having an atmospheric boiling point of ≥290° C. Generally, the pyrolysis of a hydrocarbon feed of greater molecular weight will produce a greater amount of pyrolysis tar. Besides hydrocarbon, the feed to pyrolysis optionally further comprise diluent, e.g., one or more of nitrogen, water, etc. For example, the feed may further comprise ≥1.0 wt. % diluent based on the weight of the feed, such as ≥25.0 wt. %. When the diluent includes an appreciable amount of steam, the pyrolysis is referred to as steam cracking. The hydrocarbon product of a steam cracker furnace generally includes (i) lower molecular weight compounds such as one or more of acetylene, ethylene, propylene, butenes, and (ii) higher molecular weight compounds such as one or more $C_{5+}$ compounds, and mixtures thereof, including SCT. SCT is typically separated from the aqueous and/or hydrocarbon product of a steam cracker in one or more separation stages. Other streams that may be separated from the steam cracking furnace effluent include one or more of (a) steam-cracked naphtha ("SCN", e.g., $C_5$-$C_{10}$ species) and steam cracked gas oil ("SCGO"), the SCGO comprising ≥90.0 wt. % based on the weight of the SCGO of molecules (e.g., $C_{10}$-$C_{17}$ species) having an atmospheric boiling point in the range of about 400° F. to 550° F. (200° C. to 290° C.). SCT is typically included in a separator bottoms stream, which typically comprises ≥90.0 wt. % SCT, based on the weight of the bottoms stream. The SCT can have, e.g., a boiling range ≥about 550° F. (290° C.) and can comprise molecules and mixtures thereof having a number of carbon atoms ≥about 15.

Steam cracking furnaces typically include two main sections: a convection section and a radiant section, the radiant section typically containing fired heaters. Flue gas from the fired heaters is conveyed out of the radiant section to the convection section. The flue gas flows through the convection section and is then conducted away, e.g., to one or more treatments for removing combustion by-products such as $NO_x$. Hydrocarbon is introduced into tubular coils (convection coils) located in the convection section. Steam is also introduced into the coils, where it combines with the hydrocarbon to produce a pyrolysis feed. The combination of indirect heating by the flue gas and direct heating by the steam leads to vaporization of at least a portion of the pyrolysis feed's hydrocarbon component. The pyrolysis feed containing the vaporized hydrocarbon component is then transferred from the convection coils to tubular radiant tubes located in the radiant section. Indirect heating of the pyrolysis feed in the radiant tubes results in cracking of at least a portion of the pyrolysis feed's hydrocarbon component. Pyrolysis effluent is conducted out of the radiant tube, and away from the pyrolysis furnace, the pyrolysis effluent comprising products resulting from the pyrolysis of the pyrolysis feedstock and any unconverted components of the pyrolysis feed. At least one separation stage is generally located downstream of the pyrolysis furnace, the separation stage being utilized for separating from the pyrolysis effluent one or more of light olefin, SCN, SCGO, SCT, water, unreacted hydrocarbon components of the pyrolysis feedstock, etc.

The pyrolysis feedstock for steam cracking typically comprises hydrocarbon and steam. In certain aspects, the pyrolysis feedstock comprises ≥10.0 wt. % hydrocarbon, based on the weight of the pyrolysis feedstock, e.g., ≥25.0 wt. %, ≥50.0 wt. %, such as ≥65 wt. %. Although the pyrolysis feedstock's hydrocarbon can comprise one or more light hydrocarbons such as methane, ethane, propane, butane etc., it can be particularly advantageous to utilize a pyrolysis feedstock comprising a significant amount of higher molecular weight hydrocarbons because the pyrolysis of these molecules generally results in more pyrolysis tar than does the pyrolysis of lower molecular weight hydrocarbons. As an example, the pyrolysis feedstock can comprise ≥1.0 wt. % or ≥25.0 wt. % based on the weight of the pyrolysis feedstock of hydrocarbons that are in the liquid phase at ambient temperature and atmospheric pressure.

The hydrocarbon component of the pyrolysis feedstock comprises ≥10.0 wt. %, e.g., ≥50.0 wt. %, such as ≥90.0 wt. % (based on the weight of the hydrocarbon) of one or more of naphtha, gas oil, vacuum gas oil, waxy residues, atmospheric residues, residue admixtures, or crude oil; including those comprising ≥about 0.1 wt. % asphaltenes. When the hydrocarbon includes crude oil and/or one or more fractions thereof, the crude oil is optionally desalted prior to being included in the pyrolysis feedstock. An example of a crude oil fraction utilized in the pyrolysis feedstock is produced by separating atmospheric pipestill ("APS") bottoms from a crude oil followed by vacuum pipestill ("VPS") treatment of the APS bottoms.

Suitable crude oils include, e.g., high-sulfur virgin crude oils, such as those rich in polycyclic aromatics. For example, the pyrolysis feedstock's hydrocarbon can include ≥90.0 wt. % of one or more crude oils and/or one or more crude oil fractions, such as those obtained from an atmospheric APS and/or VPS; waxy residues; atmospheric residues; naphthas contaminated with crude; various residue admixtures; and SCT. In these aspects, the steam cracking conditions generally include one or more of (i) a temperature in the range of 760° C. to 880° C., (ii) a pressure in the range of from 1.0 to 5.0 bars (absolute), or (iii) a cracking residence time in the range of from 0.10 to 2.0 seconds.

Pyrolysis Effluent

A pyrolysis effluent is conducted away from the pyrolysis furnace, e.g. away from a steam cracker furnace. Pyrolysis tar such as SCT is contained in the furnace's effluent. When utilizing the pyrolysis feedstock and pyrolysis conditions of any of the preceding aspects, the pyrolysis effluent generally comprises ≥1.0 wt. % of $C_2$ unsaturates and ≥0.1 wt. % of TH, the weight percents being based on the weight of the pyrolysis effluent. Optionally, the pyrolysis effluent comprises ≥5.0 wt. % of $C_2$ unsaturates and/or ≥0.5 wt. % of TH, such as ≥1.0 wt. % TH. Although the pyrolysis effluent generally contains a mixture of the desired light olefins, SCN, SCGO, pyrolysis tar (such as SCT), and unreacted components of the pyrolysis feedstock (e.g., water in the case of steam cracking, but also in some cases unreacted hydrocarbon), the relative amount of each of these generally depends on, e.g., the pyrolysis feedstock's composition, pyrolysis furnace configuration, process conditions during the pyrolysis, etc. The pyrolysis effluent is generally conducted away for the pyrolysis section, e.g., for cooling and separation.

In certain aspects, the pyrolysis effluent's TH comprise ≥10.0 wt. % of TH aggregates having an average size in the range of 10.0 nm to 300.0 nm in at least one dimension and an average number of carbon atoms ≥50, the weight percent being based on the weight of Tar Heavies in the pyrolysis effluent. Generally, the aggregates comprise ≥50.0 wt. %, e.g., ≥80.0 wt. %, such as ≥90.0 wt. % of TH molecules having a C:H atomic ratio in the range of from 1.0 to 1.8, a molecular weight in the range of 250 to 5000, and a melting point in the range of 100° C. to 700° C.

Although not required, the pyrolysis effluent is typically cooled downstream of the pyrolysis furnace. Generally, a cooling stage is located between the pyrolysis furnace and the separation stage. Conventional cooling means can be utilized by the cooling stage, e.g., one or more of direct quench and/or indirect heat exchange (e/g/, transfer line heat exchange), but the invention is not limited thereto. For example, the transfer-line heat exchangers can cool the pyrolysis effluent to a temperature in the range of about 700° C. to 350° C., in order to efficiently generate super-high pressure steam which can be utilized by the process or conducted away. If desired, the pyrolysis effluent can be subjected to direct quench, e.g., at a location between the furnace outlet and the separation stage.

Pyrolysis Tars

At least one separation stage is typically utilized downstream of the pyrolysis furnace and downstream of the transfer line exchanger and/or quench location. Generally, the separation stage removes one or more of light olefin, SCN, SCGO, pyrolysis tars (e.g. SCT), and water from the pyrolysis effluent. Conventional separation equipment can be utilized in the separation stage, e.g., one or more flash drums, fractionators, water-quench towers, indirect condensers, etc., such as those described in U.S. Pat. No. 8,083,931. The separation stage can be utilized for separating a pyrolysis tar stream (or in the event of steam cracking, an SCT stream) from the pyrolysis effluent. The pyrolysis tar stream typically contains ≥90.0 wt. % of pyrolysis tar or SCT, based on the weight of the tar stream, e.g., ≥95.0 wt. %, such as ≥99.0 wt. %, with ≥90 wt. % of the balance of the tar stream being particulates, for example. The tar stream comprises ≥10.0% (on a weight basis) of the pyrolysis effluent's TH, based on the weight of the pyrolysis effluent's tar heavies. The pyrolysis tar stream can be obtained, e.g., from an SCGO stream and/or a bottoms stream of the steam cracker's primary fractionator, from flash-drum bottoms (e.g., the bottoms of one or more flash drums located downstream of the pyrolysis furnace and upstream of the primary fractionator), or a combination thereof. For example, the pyrolysis tar stream can be a mixture of primary fractionator bottoms and tar knock-out drum bottoms.

When a pyrolysis tar exhibits an $R_T > R_{eff}$, blending the pyrolysis tar with a second tar having a lesser $R_T$ can be used to produce a pyrolysis tar blend having an $R_T \leq R_{eff}$. Precipitation of particulates (e.g., asphaltenes) during and after blending is lessened when the first pyrolysis tar (which may itself be a mixture of pyrolysis tars) has an $S_{BN} > 135$ and an $I_N > 80$ and the $S_{BN}$ of the blended tar composition is at least 20 solvency units greater than the second pyrolysis tar's (and/or the blended pyrolysis tar's) $I_N$. For example, it can be desirable to carry out blending such that (i) the first pyrolysis tar has an $S_{BN} > 135$ and an $I_N > 80$, (ii) the second pyrolysis tar has an $S_{BN}$ that is less than that of the first pyrolysis tar, (iii) the blended tar composition has an $S_{BN}$ that is less than that of the first pyrolysis tar, (iv) the second pyrolysis tar (and/or the blend) has an $I_N$ that is less than that of the first pyrolysis tar, and (v) the $S_{BN}$ of the blended tar composition is at least 20 solvency units greater than the second pyrolysis tar's $I_N$, or more preferred, at least 30 solvency units, or most preferred, at least 40 solvency units greater than the second pyrolysis tar's $I_N$. Optionally, the second tar's (or any additional tar's) $I_N$ is less than the $S_{BN}$ of the final pyrolysis tar blend.

The pyrolysis tar can be an SCT, for example. SCT generally comprises ≥50.0 wt. %, such as, ≥90.0 wt. %, of the pyrolysis effluent's TH based on the weight of the pyrolysis effluent's TH. For example, the SCT can have (i) a TH content in the range of from 5.0 wt. % to 40.0 wt. %, based on the weight of the SCT, (ii) an API gravity (measured at a temperature of 15.8° C.) of ≤−7.5° API, such as ≤−8.0° API, or ≤−8.5° API; and (iii) a 50° C. viscosity in the range of 200 cSt to $1.0\times10^7$ cSt. The SCT can have, e.g., a sulfur content that is >0.5 wt. %, e.g., in the range of 0.5 wt. % to 7.0 wt. %, based on the weight of the SCT. In aspects where pyrolysis feedstock does not contain an appreciable amount of sulfur, the SCT can comprise ≤0.5 wt. % sulfur, e.g., ≤0.1 wt. %, such as ≤0.05 wt. % sulfur, based on the weight of the SCT. The amount of olefin in the SCT is generally ≤10.0 wt. %, e.g., ≤5.0 wt. %, such as ≤2.0 wt. %, based on the weight of the SCT. More particularly, the amount of (i) vinyl aromatics in the SCT is generally ≤5.0 wt. %, e.g., ≤3 wt. %, such as ≤2.0 wt. % and/or (ii) aggregates in the SCT which incorporate vinyl aromatics is generally ≤5.0 wt. %, e.g., ≤3 wt. %, such as ≤2.0 wt. %, the weight percents being based on the weight of the SCT. In one aspect, the pyrolysis tar has an $I_N > 80$ and >70 wt. % of the pyrolysis tar's molecules have an atmospheric boiling point of ≥290° C.

A steam cracker tar typically comprises ≥50.0 wt. % of the steam cracker effluent's TH, based on the weight of the steam cracker effluent's TH, e.g., ≥75.0 wt. %, such as ≥90.0 wt. %. The SCT can have, e.g., (i) a sulfur content in the range of 0.5 wt. % to 7.0 wt. %, based on the weight of the SCT; (ii) a TH content in the range of from 5.0 wt. % to 40.0 wt. %, based on the weight of the SCT; (iii) a density at 15° C. in the range of 1.01 g/cm$^3$ to 1.19 g/cm$^3$, e.g., in the range of 1.07 g/cm$^3$ to 1.18 g/cm$^3$; and (iv) a 50° C. viscosity in the range of 200 cSt to $1.0\times10^7$ cSt. The amount of olefin in the SCT is generally ≤10.0 wt. %, e.g., ≤5.0 wt. %, such as ≤2.0 wt. %, based on the weight of the pyrolysis tar or SCT. More particularly, the amount of (i) vinyl aromatics in the SCT and/or (ii) within aggregates in the SCT which incorporate vinyl aromatics is generally ≤5.0 wt. %, e.g., ≤3 wt. %, such as ≤2.0 wt. %, based on the weight of the SCT.

Optionally, the SCT has a density measured at 15° C. in the range of 1.01 g/cm$^3$ to 1.19 g/cm$^3$. The invention is particularly advantageous for SCT's having density at 15° C. that is ≥1.10 g/cm$^3$, e.g., ≥1.12 g/cm$^3$, ≥1.14 g/cm$^3$, ≥1.16 g/cm$^3$, or ≥1.17 g/cm$^3$. Optionally, the SCT has a viscosity measured at 50° C. in the range of 200 cSt to $1.0\times10^7$ cSt, e.g., ≥$1.0\times10^4$ cSt, such as ≥$1.0\times10^5$ cSt, or ≥$1.0\times10^6$ cSt, or even ≥$1.0\times10^7$ cSt.

Optionally, the SCT has a normal boiling point ≥290° C., a viscosity at 15° C.≥$1\times10^4$ cSt, and a density ≥1.1 g/cm$^3$. The SCT can be a mixture which includes a first SCT and one or more additional pyrolysis tars, e.g., a combination of the first SCT and one or more additional SCTs. When the SCT is a mixture, it is typical for at least 70 wt. % of the mixture to have a normal boiling point of at least 290° C., and include free radicals. When the mixture comprises a first and second pyrolysis tars (one or more of which is optionally an SCT) ≥90 wt. % of the second pyrolysis tar optionally has a normal boiling point ≥290° C.

Desired Pyrolysis Tar Radical Profile

The fouling tendency of a pyrolysis tar during hydroprocessing varies from one batch to another depending upon, for example, the pyrolysis tar's thermal history during pyrolysis and thereafter. While not wishing to be bound by any particular theory, it is believed that the tendency of a pyrolysis tar to foul can be determined based on the concentrations of free radicals in a suitably-prepared sample of the pyrolysis tar. The pyrolysis tar sample's free radical content can be measured using ESR, for example. The pyrolysis tar sample is prepared by (i) separating a suitably-sized sample from the pyrolysis tar at a temperature $T_1$ that is ≤350° C., (ii) exposing the sample to an elevated temperature that exceeds $T_1$ by at least 10° C. for a heating time $t_h$, (iii) cooling the sample to a temperature ≤$T_1$, and (iv) determining the free radical content of the cooled sample, e.g., using ESR. The ESR measurement can be carried out at a temperature ≤$T_1$, e.g., at ambient temperature. $R_T$ can be determined from cooled pyrolysis tar samples by ESR as follows.

A suitable amount, e.g., 5.5±1 mg, of the cooled pyrolysis tar is loaded into a glass capillary having a diameter of about 1.1 mm. The sample occupies about 10 mm of the capillary's length. Although the capillary can be loaded at any convenient temperature $T_1$≤350° C., it can be beneficial to expose the pyrolysis tar to a temperature of 100° C. for 1 hr. in an oven in order to increase the viscosity of the tar for easier loading of the capillary. The sample loaded capillary is weighed and then placed inside a glass tube of 2 mm diameter×30 mm length. The glass tube is purged with nitrogen for at least about 15 seconds and then sealed by exposing each end of the tube to a burner. Purging is believed to effectively limit the influence of oxygen on the reaction and on the free radical measurement.

The sample is prepared by exposing it to a temperature $T_2$≥$T_1$+10° C., for a heating time $t_h$ to produce additional free radicals in the sample. Heating rate is adjusted so that the sample is substantially in thermal equilibrium at temperature $T_2$ within a time ≤$t_h$, e.g., ≤0.75*$t_h$, such as ≤0.5*$t_h$, or ≤0.25*$t_h$, or ≤0.1*$t_h$. Temperature $T_2$ is typically ≥375° C., e.g., ≥400° C., or ≥420° C., or ≥440° C., or ≥460° C., or ≥480° C., or ≥500° C. Heating time $t_h$ is ≥30 seconds, e.g., ≥1.0 minute, such as ≥1.5 minutes, or ≥2.0 minutes, or ≥2.5 minutes, or ≥3.0 minutes, or ≥5.0 minutes, or ≥7.5 minutes, or ≥10.0 minutes, or ≥15.0 minutes, or ≥20.0 minutes, or ≥30.0 minutes, or ≥40.0 minutes. In certain aspects, time $T_2$ is substantially the same as the average bed temperature of the hydroprocessing reactor, and $t_h$ is substantially the same as the average residence time of the pyrolysis tar in the hydroprocessing reactor. Doing so has been found to increase the effectiveness of the comparison of $T_T$ and $R_{ref}$, particularly when $R_{ref}$ is established under substantially the same hydroprocessing conditions as $R_T$.

Sample preparation also includes cooling (e.g., quenching) the heated sample from $T_2$ to a temperature $T_3$, wherein $T_3$≤$T_1$. Cooling rate is adjusted so that the sample is substantially in thermal equilibrium at temperature $T_3$ within a time ≤$t_h$, e.g., ≤0.75*$t_h$, such as ≤0.5*$t_h$, or ≤0.25*$t_h$, or ≤0.1*$t_h$.

$R_T$ and $R_{ref}$ can be determined by any convenient method, including conventional methods such as ESR. Typically, the method selected for measuring $R_T$ is substantially the same as that utilized for establishing $R_{ref}$. Suitable instruments for measuring ESR include Electron Spin Resonance Spectrometer, Model JES FA 200 (available from JEOL, Japan). The ESR measurement can be carried out at any convenient temperature ≤$T_3$, e.g., ambient temperature. The ESR spectrometer can be calibrated using, e.g., 2,2-diphenyl-1-picrylhydrazyl (DPPH).

In certain aspects, the pyrolysis tar is selected from among those where at least 70 wt. % of the pyrolysis tar mixture has a normal boiling point of at least 290° C., and optionally having an $I_N$>80. When hydroprocessing such a pyrolysis tar in the presence of the specified utility fluid and under the specified hydroprocessing conditions which include an average bed temperature ≥480° C. (e.g., ≥500° C.), for an average pyrolysis tar residence time in the reactor of at least 120 seconds (e.g., at least 160 seconds), $R_{ref}$ can be. ≤$5\times10^{19}$ spins per gram of pyrolysis tar, e.g., $R_{ref}$≤$1\times10^{19}$ spins per gram of pyrolysis tar, such as ≤$5\times10^{18}$ spins per gram of pyrolysis tar, or ≤$2\times10^{18}$ spins per gram of pyrolysis tar, or ≤$1\times10^{18}$ spins per gram of pyrolysis tar.

Certain forms of pyrolysis tar hydroprocessing will now be described in more detail. The invention is not limited to these forms, and this description is not meant to foreclose the use of other hydroprocessing forms within the broader scope of the invention.

Utility Fluids

Pyrolysis tar is typically combined with a utility fluid prior to hydroprocessing, e.g., with a utility fluid which largely comprises a mixture of multi-ring compounds. The rings can be aromatic or non-aromatic and can contain a variety of substituents and/or heteroatoms. For example, the utility fluid can contain ≥40.0 wt. %, ≥45.0 wt. %, ≥50.0 wt. %, ≥55.0 wt. %, or ≥60.0 wt. %., based on the weight of the utility fluid, of aromatic and non-aromatic ring compounds. Preferably, the utility fluid comprises aromatics. More preferably, the utility fluid comprises ≥25.0 wt. %, ≥40.0 wt. %, ≥50.0 wt. %, ≥55.0 wt. %, or ≥60.0 wt. % aromatics, based on the weight of the utility fluid.

Typically, the utility fluid comprises one, two, and three ring aromatics. Preferably the utility fluid comprises ≥15 wt. %, ≥20 wt. %, ≥25.0 wt. %, ≥40.0 wt. %, ≥50.0 wt. %, ≥55.0 wt. %, or ≥60.0 wt. % 2-ring and/or 3-ring aromatics, based on the weight of the utility fluid. The 2-ring and 3-ring aromatics are preferred due to their higher $S_{BN}$.

The utility fluid can have an ASTM D86 10% distillation point ≥60° C. and a 90% distillation point ≤425° C., typically ≤400° C. In certain aspects, the utility fluid has a true boiling point distribution with an initial boiling point ≥130° C. (266° F.) and a final boiling point ≤566° C. (1050° F.). In other aspects, the utility fluid can have a true boiling point distribution with an initial boiling point ≥150° C. (300° F.) and a final boiling point ≤430° C. (806° F.). In still other aspects, the utility fluid can have a true boiling point distribution with an initial boiling point ≥177° C. (350° F.) and a final boiling point ≤425° C. (797° F.). True boiling point distributions ("TBP", the distribution at atmospheric pressure) can be determined, e.g., by conventional methods such as the method of ASTM D7500. When the final boiling point is greater than that specified in the standard, the true boiling point distribution can be determined by extrapolation.

The relative amounts of utility fluid and tar stream employed during hydroprocessing are generally in the range of from about 20.0 wt. % to about 95.0 wt. % of the tar stream and from about 5.0 wt. % to about 80.0 wt. % of the utility fluid, based on total weight of utility fluid plus tar stream. For example, the relative amounts of utility fluid and tar stream during hydroprocessing can be in the range of (i) about 20.0 wt. % to about 90.0 wt. % of the tar stream and about 10.0 wt. % to about 80.0 wt. % of the utility fluid, or (ii) from about 40.0 wt. % to about 90.0 wt. % of the tar stream and from about 10.0 wt. % to about 60.0 wt. % of the utility fluid. In an embodiment, the utility fluid:tar weight ratio can be ≥0.01, e.g., in the range of 0.05 to 4.0, such as in the range of 0.1 to 3.0, or 0.3 to 1.1. At least a portion of the utility fluid can be combined with at least a portion of the tar stream within the hydroprocessing vessel or hydroprocessing zone, but this is not required, and in one or more embodiments at least a portion of the utility fluid and at least a portion of the tar stream are supplied as separate streams and combined into one feed stream prior to entering (e.g., upstream of) the hydroprocessing stage(s). For example, the tar stream and utility fluid can be combined to produce a feedstock upstream of the hydroprocessing stage, the feedstock comprising, e.g., (i) about 20.0 wt. % to about 90.0 wt. % of the tar stream and about 10.0 wt. % to about 80.0 wt. % of the utility fluid, or (ii) from about 40.0 wt. % to about 90.0 wt. % of the tar stream and from about 10.0 wt. % to about 60.0 wt. % of the utility fluid, the weight percents being based on the weight of the feedstock.

In certain aspects, a pyrolysis tar (or a pyrolysis tar mixture) is combined with a utility fluid having an $S_{BN}$≥100, e.g., $S_{BN}$≥110, the pyrolysis tar having incompatibility number ($I_N$)>70, e.g., >80, and wherein >70 wt. % of the pyrolysis tar's molecules have an atmospheric boiling point of ≥290° C. After being combined with a utility fluid, the utility fluid and tar mixture can have, e.g., a solubility blending number ($S_{BN}$)≥110, such as ≥120, or ≥130. It has been found that there is a beneficial decrease in reactor plugging when hydroprocessing pyrolysis tars having incompatibility number ($I_N$)>110 provided that, after being combined, the utility fluid, the mixture has a solubility blending number ($S_{BN}$)≥150, ≥155, or ≥160. The pyrolysis tar (or mixture of pyrolysis tars) can have a relatively large incompatibility number ($I_N$)>80, especially >100, or >110, provided the utility fluid has a high solubility blending number ($S_{BN}$), for example, $S_{BN}$≥100, ≥120, or ≥140.

The combined pyrolysis tar and utility fluid is hydroprocessed in the presence of a treatment gas comprising molecular hydrogen, and generally in the presence of at least one catalyst which is typically located in at least one hydroprocessing zone. The upgraded pyrolysis tar product (the hydroprocessed pyrolysis tar) generally has a decreased viscosity, decreased atmospheric boiling point range, and increased hydrogen content over that of the pyrolysis tar feedstock, resulting in improved compatibility with other heavy oil blendstock, and improved utility as a fuel oil and blend-stock. Additionally, efficiency advances involving recycling a portion of the upgraded pyrolysis tar product as utility fluid are described in International Publication No. WO 2013/033590 also incorporated herein by reference in its entirety. Provided the hydroprocessing is carried out under the specified mild conditions, e.g., employing a pyrolysis tar feed having an $R_T$ that does not exceed $R_{ref}$, hydroprocessor run length is typically at least 10 times longer than would be the case in conventional pyrolysis tar hydroprocessing, e.g., ≥100 times longer, such as ≥1000 times longer.

Hydroprocessing

Hydroprocessing is carried out under hydroprocessing conditions, e.g., under conditions for carrying out one or more of hydrocracking (including selective hydrocracking), hydrogenation, hydrotreating, hydrodesulfurization, hydrodenitrogenation, hydrodemetallation, hydrodearomatization, hydroisomerization, or hydrodewaxing of the specified pyrolysis tar. The hydroprocessing reaction can be carried out in at least one vessel or zone that is located, e.g., within a hydroprocessing stage downstream of the pyrolysis stage and separation stage. The specified pyrolysis tar stream generally contacts the hydroprocessing catalyst in the vessel or zone, in the presence of the utility fluid and molecular hydrogen. Pyrolysis tar hydroprocessing conditions can include, e.g., exposing the combined diluent-tar stream to a temperature in the range from 200° C. to 500° C. or from 250° C. to 450° C. or from 300° C. to 430° C. Typically, the foregoing hydroprocessing temperatures are the average temperature of the hydroprocessing reactor's catalyst bed (one half the difference between the bed's inlet and outlet temperature). When the hydroprocessing reactor contains more than one hydroprocessing zone and/or more than one catalyst bed (e.g., as shown in FIG. 2, the foregoing temperatures are typically the average temperature in the hydroprocessing reactor, e.g., (one half the difference between the temperature of the most upstream catalyst bed's inlet and the temperature of the most downstream catalyst bed's outlet temperature).

Hydroprocessing is carried out in the presence of hydrogen, e.g., by (i) combining molecular hydrogen with the tar stream and/or utility fluid upstream of the hydroprocessing, and/or (ii) conducting molecular hydrogen to the hydroprocessing stage in one or more conduits or lines. Although relatively pure molecular hydrogen can be utilized for the hydroprocessing, it is generally desirable to utilize a "treat gas" which contains sufficient molecular hydrogen for the hydroprocessing and optionally other species (e.g., nitrogen and light hydrocarbons such as methane) which generally do not adversely interfere with or affect either the reactions or the products. Unused treat gas can be separated from the hydroprocessed effluent for re-use, generally after removing undesirable impurities, such as $H_2S$ and $NH_3$. The treat gas optionally contains ≥about 50 vol. % of molecular hydrogen, e.g., ≥about 75 vol. %, based on the total volume of treat gas conducted to the hydroprocessing stage.

Figure 2:
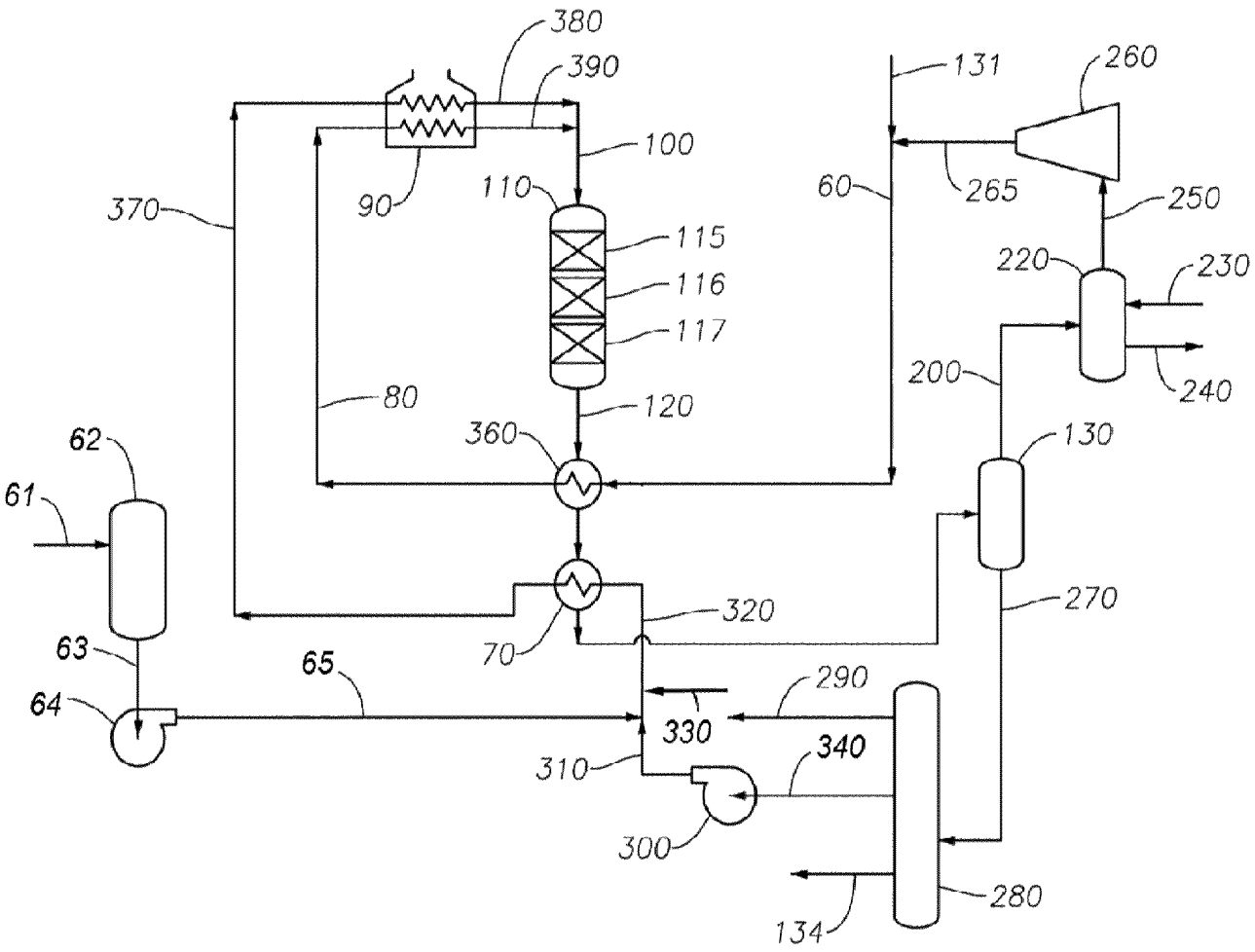
FIG. 2 is a schematic representing a hydroprocessing reaction sequence.

In one suitable form of hydroprocessing, shown schematically in FIG. 2, a pyrolysis tar stream is introduced via conduit 61 to separation stage 62 for separation of one or more light gases and/or particulates from the pyrolysis tar stream. The remaining pyrolysis tar stream is collected in conduit 63 and transferred by pump 64 through conduit 65 for mixing with a utility fluid supplied via line 310. The pyrolysis tar—utility fluid mixture (tar-fluid mixture) is then conducted to a first pre-heater 70 via conduit 320. Optionally, a supplemental utility fluid, may be added via conduit 330. The combined stream, the tar-fluid mixture (which is primarily in liquid phase) is conducted to a supplemental pre-heat stage 90 via conduit 370. The supplemental pre-heat stage 90 can be, e.g., a fired heater. Recycled treat gas, comprising molecular hydrogen, is obtained from conduit 265 and, if necessary, is mixed with fresh treat gas, supplied through conduit 131. The treat gas is conducted via conduit 60 to a second pre-heater 360, before being conducted to the supplemental pre-heat stage 90 via conduit 80. Fouling can occur in pre-heat stage 90, and it has been observed that the occurrence (or amount) of such fouling is decreased when $R_T$ does not exceed $R_{ref}$.

The pre-heated tar-fluid mixture (from line 380) is combined with the pre-heated treat gas (from line 390) and then conducted via line 100 to a hydroprocessing reactor 110. Mixing means are utilized for combining the pre-heated tar-fluid mixture with the pre-heated treat gas in hydroprocessing reactor 110, e.g., one or more gas-liquid distributors of the type conventionally utilized in fixed bed reactors. The tar is hydroprocessed in the presence of the utility fluid, supplemental utility fluid, the treat gas, and hydroprocessing catalyst in at least one catalyst bed 115. Additional catalyst beds, e.g., 116, 117, etc., may be connected in series with the catalyst bed 115 with optional intercooling quench using treat gas from conduit 60 being provided between beds (not shown).

The hydroprocessed effluent is conducted away from hydroprocessing reactor 110 via conduit 120. When the first and second preheaters 70, 360 are heat exchangers, the hot hydroprocessing effluent in conduit 120 can be used to preheat the tar/utility fluid and the treat gas respectively by indirect heat transfer. Following this optional heat exchange, the hydroprocessed effluent is conducted to separation stage 130 for separating total vapor product (e.g., heteroatom vapor, vapor-phase cracked products, unused treat gas, etc.) and total liquid product ("TLP") from the hydroprocessed effluent. The total vapor product is conducted via line 200 to upgrading stage 220, which comprises, e.g., one or more amine towers. Fresh amine is conducted to stage 220 via line 230, with rich amine conducted away via line 240. Unused treat gas is conducted away from stage 220 via line 250, compressed in compressor 260, and conducted via lines 265, 60, and 80 for re-cycle and re-use in the hydroprocessing stage 110.

The TLP from separation stage 130 typically comprises hydroprocessed pyrolysis tar, e.g., ≥10 wt. % of hydroprocessed pyrolysis tar, such as ≥50 wt. %, or ≥75 wt. %, or ≥90 wt. %. The TLP optionally contains non-tar components, e.g., hydrocarbon having a true boiling point range that is substantially the same as that of the utility fluid (e.g., unreacted utility fluid). The TLP, which is an upgraded tar product, is useful as a diluent (e.g., a flux) for heavy hydrocarbons, especially those of relatively high viscosity. Optionally, all or a portion of the TLP can substitute for more expensive, conventional diluents. Non-limiting examples of heavy, high-viscosity streams suitable for blending with the bottoms include one or more of bunker fuel, burner oil, heavy fuel oil (e.g., No. 5 or No. 6 fuel oil), high-sulfur fuel oil, low-sulfur fuel oil, regular-sulfur fuel oil (RSFO), and the like.

The TLP from separation stage 130 is conducted via line 270 to a further separation stage 280, e.g., for separating from the TLP one or more of hydroprocessed pyrolysis tar, additional vapor, and at last one stream suitable for use as recycle as utility fluid or a utility fluid component. Separation stage 280 may be, for example, a distillation column with side-stream draw although other conventional separation methods may be utilized. The TLP is separated in further separation stage 280 into an overhead stream, a side stream and a bottoms stream, listed in order of increasing boiling point. The overhead stream (e.g., vapor) is conducted away from separation stage 280 via line 290. The bottoms stream (typically comprising hydroprocessed pyrolysis tar) is conducted away via line 134. The overhead and bottoms streams may be carried away for further processing. If desired, at least a portion of the bottoms can be utilized within the process and/or conducted away for storage or further processing. The bottoms portion of the TLP can be desirable as a diluent (e.g., a flux) for heavy hydrocarbons as described above. In certain embodiments, the overhead stream 290 and bottoms stream 134 of separation stage 280 are combined to form an upgraded tar product (not shown).

Preferably, the operation of separation stage 280 is adjusted to shift the boiling point distribution of side stream 340 so that side stream 340 has properties desired for the utility fluid. Side stream 340 can have a true boiling point distribution having an initial boiling point ≥177° C. (350° F.) and a final boiling point ≤566° C. (1050° F.). The side stream can also have a true boiling point distribution having an initial boiling point ≥177° C. (350° F.) and a final boiling point ≤430° C. (800° F.). The side stream can have $S_{BN}$≥100, e.g., ≥120, such as ≥125, or ≥130. Optionally, trim molecules may be separated, for example, in a fractionator (not shown), from separation stage 280 bottoms or overhead or both and added to the side stream 340 as desired. The side stream is carried away from separation stage 280 via conduit 340. In the hydroprocessing form illustrated in FIG. 2, at least a portion of the side stream 340 is utilized as utility fluid and conducted via pump 300 and conduit 310. The utility fluid comprises, e.g., ≥10 wt. % of the side stream, based on the weight of the utility fluid.

Conventional hydroprocessing catalysts can be utilized for hydroprocessing the pyrolysis tar stream in the presence of the utility fluid, such as those specified for use in resid and/or heavy oil hydroprocessing, but the invention is not limited thereto. Suitable hydroprocessing catalysts include those comprising (i) one or more bulk metals, and/or (ii) one or more metals on a support. The metals can be in elemental form or in the form of a compound. In one or more embodiments, the hydroprocessing catalyst includes at least one metal from any of Groups 5 to 10 of the Periodic Table of the Elements (tabulated as the Periodic Chart of the Elements, The Merck Index, Merck & Co., Inc., 1996). Examples of such catalytic metals include, but are not limited to, vanadium, chromium, molybdenum, tungsten, manganese, technetium, rhenium, iron, cobalt, nickel, ruthenium, palladium, rhodium, osmium, iridium, platinum, or mixtures thereof. In certain embodiments, the catalysts include one or more of KF860 available from Albemarle Catalysts Company LP, Houston Tex.; Nebula® Catalyst, such as Nebula® 20, available from the same source; Centera® catalyst, available from Criterion Catalysts and Technologies, Houston Tex., such as one or more of DC-2618, DN-2630, DC-2635, and DN-3636; Ascent® Catalyst, available from the same source, such as one or more of DC-2532, DC-2534, and DN-3531; and FCC pretreat catalyst, such as DN3651 and/or DN3551, available from the same source. However, the invention is not limited to only these catalysts.

In certain aspects, the catalyst has a total amount of Groups 5 to 10 metals per gram of catalyst of at least 0.0001 grams, or at least 0.001 grams or at least 0.01 grams, in which grams are calculated on an elemental basis. For example, the catalyst can comprise a total amount of Group 5 to 10 metals in a range of from 0.0001 grams to 0.6 grams, or from 0.001 grams to 0.3 grams, or from 0.005 grams to 0.1 grams, or from 0.01 grams to 0.08 grams. In particular aspects, the catalyst further comprises at least one Group 15 element. An example of a preferred Group 15 element is phosphorus. When a Group 15 element is utilized, the catalyst can include a total amount of elements of Group 15 in a range of from 0.000001 grams to 0.1 grams, or from 0.00001 grams to 0.06 grams, or from 0.00005 grams to 0.03 grams, or from 0.0001 grams to 0.001 grams, in which grams are calculated on an elemental basis.

Hydroprocessing Parameter Selection

Design of the hydroprocessing reactor and the selection of hydroprocessing catalyst and hydroprocessing process conditions are typically selected to achieve efficient production of TLP, hydroprocessed tar, etc. utilizing available pyrolysis tar feeds. Typical "Standard" hydroprocessing process conditions include a temperature ≥200° C., a pressure ≥8 MPa and a weight hourly space velocity of the feed mixture that is ≥0.3 $hr^{-1}$. For particular process conditions within these Standard conditions, a reference free radical content $R_{ref}$ can be determined. Pyrolysis tar feeds exhibiting an $R_T$ that exceeds $R_{ref}$ have a greater potential for fouling the hydroprocessing reactor when operating at or near those particular process conditions. Although $R_{ref}$ for particular process conditions (or a set of particular process conditions spanning the Standard conditions) can be determined from modeling studies, e.g., by modeling the yield of heavy hydrocarbon deposits under selected hydroprocessing conditions, it is typically more convenient to determine $R_{ref}$ experimentally. This can be done by providing a set of approximately ten pyrolysis tars (or tar mixtures). Each pyrolysis tar in the set has an $R_T$ different from that of the others (ideally the $R_T$ values are substantially equally spaced), and each has an $R_T$ (e.g., as measured by ESR) within the range of $1\times10^{17}$ spins per gram of tar to $1\times10^{20}$ spins per gram of tar. A table of $R_{ref}$ values can be produced by hydroprocessing each pyrolysis tar in the set at a plurality of selected hydroprocessing conditions within the standard conditions (e.g., conditions of increasing severity), and observing whether reactor fouling occurs. When it is desired to designate for hydroprocessing a pyrolysis tar feed that is not a member of the foregoing set under particular hydroprocessing conditions within the Standard range, $R_T$ of the pyrolysis tar feed is measured as specified, and this value of $R_T$ is compared to that $R_{eff}$ selected among the tabulated $R_{ref}$ values which most closely corresponds to the selected hydroprocessing conditions. Hydroprocessing of the designated pyrolysis tar can be carried out efficiently with little or no reactor fouling at the selected Standard hydroprocessing conditions when $R_T$ is less than $R_{ref}$, e.g., ≤75% of $R_{ref}$, such as ≤50% of $R_{ref}$, or ≤25% of $R_{ref}$.

Standard hydroprocessing conditions include a temperature $T_a$≥200° C., e.g., ≥400° C., such as in the range of from 350° C. to 420° C. $T_a$ which can be an average bed temperature, is typically in the range of from 300° C. to 500° C., or 350° C. to 430° C., or 360° C. to 420° C. Standard hydroprocessing conditions also include a molecular hydrogen partial pressure during the hydroprocessing is generally >8 MPa, such as at least 9 MPa, for example at least 10 MPa, although in certain aspects it is ≤14 MPa, such as ≤13 MPa, for example, ≤12 MPa. Weight hourly space velocity ($WHSV_a$) of the combined diluent-pyrolysis tar stream is generally >0.3 $hr^{-1}$, such as >0.5 $hr^{-1}$, for example >1.0 $hr^{-1}$, although in certain aspects is ≤5 $hr^{-1}$, such as ≤4 $hr^{-1}$, for example ≤3 $hr^{-1}$. In particular, the Standard hydroprocessing conditions are controlled to achieve a molecular hydrogen consumption rate in the range of about 270 standard cubic meters/cubic meter (S $m^3/m^3$) to about 534 S $m^3/m^3$ (1520 SCF/B to 3000 SCF/B, where the denominator represents barrels of the pyrolysis tar stream, e.g., barrels of SCT), for example in the range of about 280 to about 430 S $m^3/m^3$, such as in the range of about 290 to about 420 S $m^3/m^3$, for example in the range of about 300 to about 410 S $m^3/m^3$. In one aspect, a weight hourly space velocity of combined pyrolysis tar and utility fluid that is >0.3 $hr^{-1}$, e.g., in the range of from 0.3 $hr^{-1}$ to 10 $hr^{-1}$, and where the hydroprocessing exhibits a 566° C.+ conversion of at least 20 wt. % substantially continuously for at least ten days (where 566° C.+ conversion means the conversion of tar molecules having boiling points ≥566° C., by hydroprocessing, into molecules having boiling points <566° C.) This 566° C.+ conversion implies a high rate of conversion of THs, a very desirable result.

Optionally, the amount of molecular hydrogen supplied to the hydroprocessing stage is in the range of from about 1000 SCF/B (standard cubic feet per barrel) (178 S $m^3/m^3$) to 10000 SCF/B (1780 S $m^3/m^3$), in which B refers to barrel of feed to the hydroprocessing stage (e.g., pyrolysis tar stream plus utility fluid). For example, the molecular hydrogen can be provided in a range of from 3000 SCF/B (534 S $m^3/m^3$) to 6000 SCF/B (1068 S $m^3/m^3$). In another aspect, the rate can be 270 standard cubic meters of molecular hydrogen per cubic meter of (the first pyrolysis tar+the second pyrolysis tar) in the feed (S $m^3/m^3$) to 534 S $m^3/m^3$ of pyrolysis tar. Preferably, the amount of molecular hydrogen used to hydroprocess the specified tar stream is less than would be the case if the pyrolysis tar stream contained greater amounts of $C_{6+}$ olefin, for example, vinyl aromatics. Optionally, greater amounts of molecular hydrogen may be consumed during hydroprocessing, e.g., when the tar stream contains relatively higher amounts of sulfur.

The density measured at 15° C. of the TLP, and particularly the hydroprocessed pyrolysis tar, is typically at least 0.10 g/$cm^3$ less than the density of the raw pyrolysis tar (before hydroprocessing, e.g., the raw pyrolysis tar conveyed as feed in conduit 61 of FIG. 2). For example, the density of the TLP and/or the hydroprocessed pyrolysis tar can be at least 0.12, preferably, at least 0.14, 0.15, or 0.17 g/$cm^3$ less than the density of the raw pyrolysis tar. The viscosity measured at 50° C. of the TLP (and/or the hydroprocessed pyrolysis tar) is typically <200 cSt. For example, the viscosity can be <150 cSt, such as <100 cSt, or <75 cSt, or <50 cSt, or <40 cSt, or <30 cSt. Generally, hydroprocessing results in a significant viscosity improvement over the pyrolysis tar feed. For example, when the viscosity of the raw pyrolysis tar measured at 50° C. is ≥$1.0\times10^4$ cSt, e.g., ≥$1.0\times10^5$ cSt, ≥$1.0\times10^6$ cSt, or ≥$1.0\times10^7$ cSt, the viscosity of the TLP and/or hydroprocessed tar measured at 50° C. is typically <200 cSt, e.g., <150 cSt, preferably, <100 cSt, <75 cSt, <50 cSt, <40 cSt, or <30 cSt.

Milder hydroprocessing conditions can be used when $R_T$ exceeds the minimum tabulated $R_{ref}$ for Standard hydroprocessing conditioning and blending to achieve a lesser $R_T$ is inconvenient or otherwise undesired.

Mild Hydroprocessing

As an alternative to or in addition to the specified blending, Mild hydroprocessing conditions can be used when $R_T$ exceeds $R_{eff}$. Such Mild hydroprocessing conditions include a temperature $T_b$≥200° C. but less than $T_a$ (e.g., (e.g., $T_b$≤$T_a$−10° C., such as ≤400° C.), a pressure ≥8 MPa, a weight hourly space velocity of the feed mixture ($WHSV_b$) that is ≥0.3 $hr^{-1}$ but greater than $WHSV_a$, and a molecular hydrogen consumption rate in the range of from 150 standard cubic meters of molecular hydrogen per cubic meter of the pyrolysis tar in the feed (S $m^3/m^3$) to about 400 S $m^3/m^3$ (845 SCF/B to 2250 SCF/B). Typically, $WHSV_b$ is ≥$WHSV_a$+0.01, e.g., ≥$WHSV_a$+0.05 $hr^{-1}$, such as, ≥$WHSV_a$+0.1 $hr^{-1}$, or, ≥$WHSV_a$+0.5 $hr^{-1}$, or ≥$WHSV_a$+1 $hr^{-1}$, or ≥$WHSV_a$+10 hr-1, or more. Typically, $T_b$ is <$T_a$, e.g., $T_b$≤$T_a$−25° C., such as $T_b$≤$T_a$−50° C. Optionally, hydroprocessing conditions result in a 566° C.+ conversion of at least 20 wt. %, this conversion being achieved without appreciable variation continuously during hydroprocessing run durations of, e.g., at least one day, such as at least five days, or at least ten days, or longer. Typically, Mild hydroprocessing conditions utilize a lesser temperature (e.g., average bed temperature) than does Standard hydroprocessing. For example, Mild hydroprocessing can be carried out at a hydroprocessing temperature ≤440° C. As in Standard hydroprocessing, in Mild hydroprocessing utilizes a feed which includes pyrolysis tar and utility fluid, where (i) the utility fluid has a true boiling point distribution having an initial boiling point ≥130° C. and a final boiling point ≤566° C., or (ii) the utility fluid comprises ≥15 wt. % of two ring and/or three ring aromatic compounds.

Although the foregoing Mild hydroprocessing conditions are effective, the invention is not limited thereto. When $R_T$ exceeds $R_{ref}$, any hydroprocessing technique that is effective for reducing fouling may be used. The higher the $R_T$ measurement is above $R_{ref}$, the greater the tendency for the pyrolysis tar to foul, and the greater need to employ the specified blending, the specified Mild hydroprocessing conditions, or to closely examine other characteristics of the hydroprocessing which may benefit from modification. For instance, the speed of the reaction may be decreased by further decreasing the hydrogen feed rate, or reducing the weight hourly space velocity of the feed, or reducing process pressures or process temperatures. If $R_T$ is significantly greater than $R_{ref}$, hydroprocessing may be contra indicated.

Experimental Results

One hundred seventeen samples are prepared from a pyrolysis tar that exhibits a low tendency to foul a hydroprocessing reactor over a wide range of hydroprocessing conditions for appreciable hydroprocessing run lengths, e.g., ≥1 day, such as ≥10 days. The pyrolysis tar is a viscous black liquid at room temperature with a density of 1.06-1.10 grams/cm$^3$, a flash point of 102° C. (ASTM D-93), an autoignition temperature of 550° C. and a boiling point range of 218-649° C. It contains 80.3% aromatic carbon, 19.7% aliphatic carbon, <5.0 wt. % anthracene, <5.0 wt. % phenanthrene, <0.1 wt. % naphthalene and >0.1 wt. % polynuclear aromatic hydrocarbons. Its compositions is 88.6 wt. % C, 4.4 wt. % H, 1.6 wt. % O, 4.3 wt. % S and 0.06 wt. % N.

This pyrolysis tar is exposed to a temperature of 100° C. for 1 hr. in an oven in order to increase the viscosity of the tar, to allow sampling of pyrolysis the tar with a capillary of 1.1 mm in diameter. The sample-loaded capillary is weighed and placed into a glass tube (2 mm diameter×30 mm length), which is purged with $N_2$ for 15 seconds and then sealed by a burner. Each pyrolysis tar sample has a mass of about 5.5±1 mg.

A first set of thirteen of the 117 samples are heated in a heating block with 20 sample slots. A first set of samples were heated with the block to 250° C. and maintained at 250° C. After 0.5 minutes, one of the samples is removed from the heating block and allowed to cool to 25° C. A second sample is removed after another 0.5 minutes (total time of 1.0 minutes at 250° C.), and allowed to cool to 25° C. This process is repeated at increased time duration increments before sample removal, resulting in a set of thirteen samples maintained at this 250° C. block temperature time durations of 0.5, 1.0, 1.5, 2.0, 2.5, 3.0, 5.0, 7.5, 10.0, 15.0, 20.0, 30.0 and 40.0 minutes (corresponding to samples 1-13). FIG. 1 shows the temperature of each sample of this first sample set over the nine time durations. The figure shows that the samples reached the block temperature quickly, and remained stable at the desired temperature over the period of the sampling procedure.

These steps are repeated at block temperatures of 300° C., 350° C., 400° C., 420° C., 440° C., 460° C., 480° C. and 500° C., using a separate set of nine samples (out of the 117) at each of these temperatures. FIG. 1 shows the temperature profile of each sample in each of the nine sets at the indicated temperatures. It can be seen that each set reached its desired temperature in less than 2 min, and the temperature fluctuation afterward is less than 0.2° C. After the sample heating is carried out for the indicated time, each of the 117 samples is rapidly quenched to ambient temperature.

The quenched samples are loaded at ambient temperature into a JEOL Electron Spin Resonance Spectrometer Model JES FA 200 (JEOL, Japan). ESR mearements are carried out at room temperature for each sample, and the results are calibrated using a sample containing 2,2-diphenyl-1-picryl-hydrazyl (DPPH). The capillaries and the glass tubes show little influence on the samples ESR results.

Figure 3:
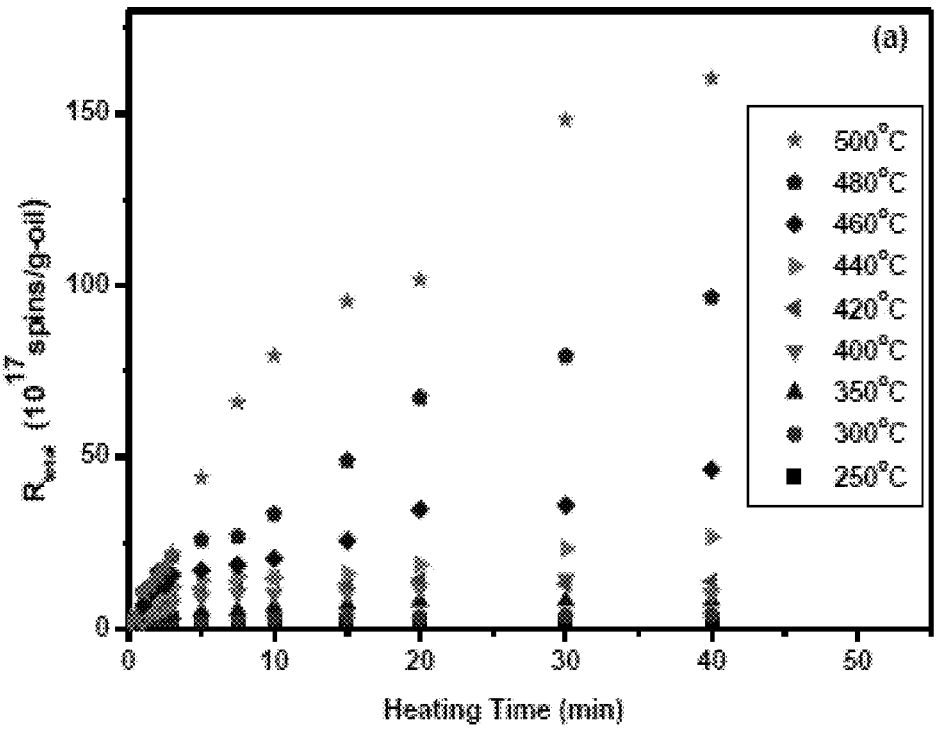
FIG. 3 is a graph of ESR measurements of pyrolysis tar over time/temperatures
Figure 4:
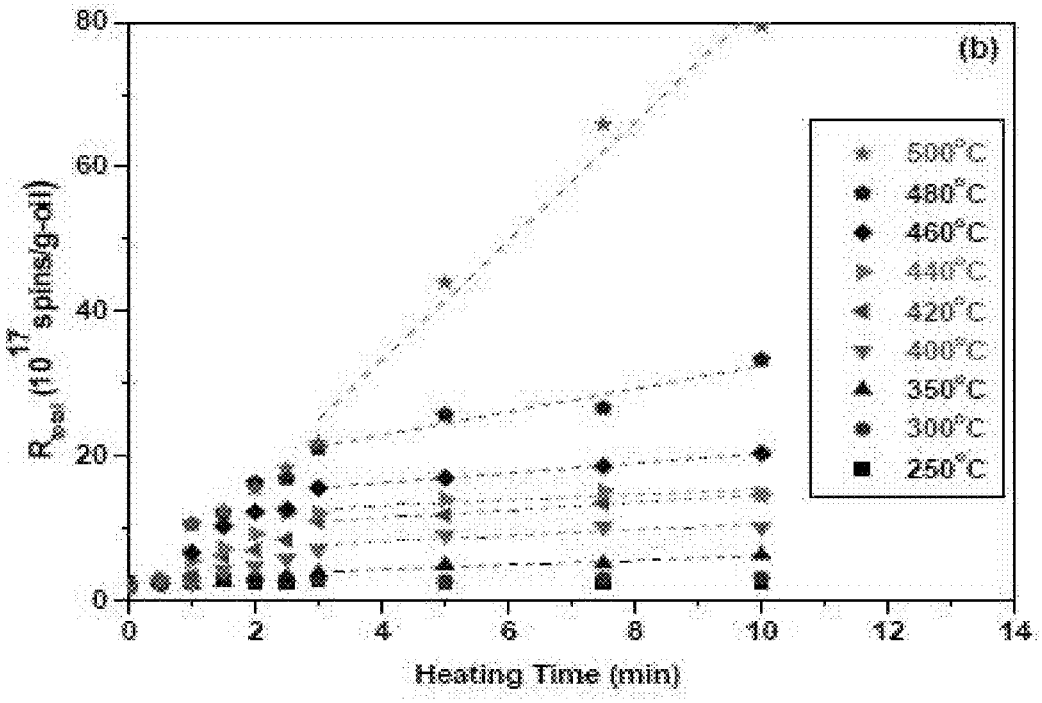
FIG. 4 is a graph of the data in FIG. 3, with the lower time periods expanded.

FIG. 3 shows the results of the indicated ESR measurements Free radical content ($R_T$, in spins/gram) appears on the "y" axis. FIG. 4 shows the same data as FIG. 3, but over a compressed time range, 0.5 to 10 minutes, as this reduce range is more representative of typical hydroprocessing reactor residence time (generally on the order of 120 seconds to 600 seconds). As shown in FIG. 4, $R_T$ for a given temperature, increases over time, indicating additional free radicals form in the pyrolysis tar at elevated (but substantially constant temperature). This behavior is surprising, particularly since the ESR measurement is carried out after sample quenching, indicating that the additional free radicals remain in the sample even at ambient temperature. While not wishing to be bound by any particular theory, it is believed that the free radicals remain in these samples because they are confined in a structure, such as a network of hydrocarbon molecules, and that these structures allow little access to other free radicals for reacting. This $R_T$ stability indicates that the $R_T$ measurements taken with the above procedure (sample, elevate temp for specified time, quench, measure ESR) can be used to predict at ambient temperature the tendency for a pyrolysis tar to foul a hydroprocessing reactor during pyrolysis tar hydroprocessing.

FIG. 3 and FIG. 4 also indicate that changes in radical formation during thermal reactions may be modeled with zero-order kinetics. The temperature effect can be represented by the Arrhenius relation, $\ln k = A_0 - E_a/RT$, where k is rate constant, $A_0$ is a pre-exponential factor, $E_a$ is activation energy in J/mol, T is temperature in Kelvin (K) and R is the gas content (8.314 J/(mol·K)). Such zero-order kinetic behavior is known to be representative of coke formation, further supporting the use of $R_T$ as a measurement of fouling potential.

Typically, pyrolysis tars have some free radical content after formation. The sampled pyrolysis tar contains an initial $R_T$ level of about $2\times10^{17}$ at temperatures ≤350° C. As shown in FIG. 3, $R_T$ does not change significantly over time for temperatures below 350° C., but begins to increase over time at temperatures >350° C. This indicates that the sampled pyrolysis tar does not react significantly below 350° C. This radical formation behavior is similar to observed radical formation in coal pyrolysis tars. Since $R_T$ does not change significantly below 350° C., ESR measurements can be taken on samples that have been cooled to 350° C. or less, without substantial differences in measurements at ambient temperature (approximately 25° C.). It is likely that more rapid quenching of the samples from $T_2$ to temperatures at or below 350° C., will improve the accuracy of the measurements.

FIG. 4 indicates that, for this low-fouling pyrolysis tar, $R_T$ remains below $2\times10^{18}$ spins per gram at temperature below 460° C. when 600≥Time≥120 seconds. FIG. 4 also indicates that $R_T$ for this pyrolysis tar, remains below $2\times10^{18}$ spins per gram at temperature below 480° C. when T≥120 seconds and ≤−160 seconds. Accordingly, hydroprocessing of this pyrolysis tar can be carried out long-term with little or no fouling under hydroprocessing conditions characterized by an $R_{ref} \geq 2\times10^{18}$ spins per gram.

Should a lesser $R_{ref}$ be indicated for the desired hydroprocessing conditions, long term hydroprocessing without appreciable fouling can be achieved by blending the sampled tar with a second pyrolysis tar having an $R_T \leq R_{ref}$. Further, as the free radical concentration is substantially stable at a given time/temperature (that is, the radicals do not combine when reducing the temperature of the sample), the blend's $R_T$ can be estimated from the radical concentrations of the first and second pyrolysis tar components, ($R_{T1}$ and $R_{T2}$) using the formula:

$$R_{Tblend} \sim \{(R_{T1}*\text{grams tar 1})+(R_{T2}*\text{grams tar 2})\}/(\text{grams tar 1}+\text{grams tar 2}).$$

$R_{Tblend}$ can be readily determined using method specified for measuring the $R_T$ of an individual pyrolysis tar. In certain aspects, the elevated temperature for use in the procedure ($T_2$) is the temperature of the desired hydroprocessing reaction (or greater), and the residence time $t_h$ at the elevated temperature, before quenching, is at least the expected residence time of the hydroprocessing reaction or greater.

For instance, a hydroprocessing is to take place at or above 480° C., with residence time of 120 seconds or greater, and an $R_{ref}$ under these conditions of $2\times10^{18}$ spins per gram. A first SCT (SCT 1) is evaluated for suitability as a feed to this process by determining a total free radical content ($R_{Tsct1}$) using the specified procedures for determining $R_T$. If $R_{Tsct1}\leq R_{ref}$, no alteration or blending of the SCT is indicated before hydroprocessing. If however $R_{Tsct1}>R_{ref}$, fouling potential is lessened by blending SCT1 with a second SCT (SCT 2), where $R_{Tsct2}<R_{ref}$ for SCT2. For instance, if $R_{Tsct1}\sim1\times10^{19}$, and $R_{Tsct2}\sim5\times10^{17}$, then a blend of 100 grams of SCT1 with about 500 grams of SCT2. (e.g., using a blend ratio of (wt. % SCT2 in blend/wt. % SCT 1 in blend) ~0.83.6/16.6, or ~5.0) is estimated to produce a blended SCT with an estimated $R_{Tblend}\sim2\times10^{18}$ spins/gram. If a blended sample measured $R_{Tblend}$ is still greater than $R_{ref}$, the blend ratio may be increased, for instance using (wt. % SCT2 in blend/wt. % SCT 1 in blend)=85/15 (or 5.67), and retest the new blend using the above procedure. For a further decreasing in fouling potential, blending can be continued beyond the blend ratio where $R_T$ does not exceed $R_{ref}$, e.g., to achieve an $R_T$ (blend)≤0.9 $R_{ref}$, such as $R_T$ (blend)≤0.75 $R_{ref}$, or $R_T$ (blend)≤0.5 $R_{ref}$.

In other aspects, instead of (or in addition to) blending, when $R_T$ exceeds $R_{ref}$, the measured $R_T$ can be used as an indicator of the potential fouling characteristics of the particular pyrolysis tar, and the hydroprocessing conditions accordingly may be modified, or made less severe (e.g., Mild conditions). Various changes to the hydroprocessing parameters can be made, such as decreasing hydroprocessing temperature, decreasing pressure, increasing weight hourly space velocity of the feed mixture, and decreasing molecular hydrogen consumption rate.

All patents, test procedures, and other documents cited herein, including priority documents, are fully incorporated by reference to the extent such disclosure is not inconsistent and for all jurisdictions in which such incorporation is permitted.

While the illustrative forms disclosed herein have been described with particularity, it will be understood that various other modifications will be apparent to and can be readily made by those skilled in the art without departing from the spirit and scope of the disclosure. Accordingly, it is not intended that the scope of the claims appended hereto be limited to the example and descriptions set forth herein, but rather that the claims be construed as encompassing all the features of patentable novelty which reside herein, including all features which would be treated as equivalents thereof by those skilled in the art to which this disclosure pertains.

When numerical lower limits and numerical upper limits are listed herein, ranges from any lower limit to any upper limit are contemplated.

The invention claimed is:

1. A hydrocarbon process, comprising:

(a) providing a first pyrolysis tar having a temperature $T_1\leq350°$ C., the pyrolysis tar being a hydrocarbon-containing mixture which includes free radicals and is derived from hydrocarbon pyrolysis, wherein at least 70 wt. % of the mixture has a normal boiling point of at least 290° C.;

(b) isolating a sample from the first pyrolysis tar and producing additional free radicals in the sample by exposing the sample to a predetermined second temperature $T_2$ for a predetermined time $t_h$, wherein $T_2\geq T_1+10°$ C.;

(c) cooling the sample to a temperature $T_3$, $T_3$ being $\leq T_1$, the cooled sample having a total free radical content $R_T$;

(d) (i) when $R_T$ does not exceed a predetermined reference free radical content Rref, conducting the first pyrolysis tar to step (e);

(ii) when $R_T$ exceeds $R_{ref}$, (A) providing a second pyrolysis tar at a temperature $\leq T_1$, the second pyrolysis tar being a hydrocarbon-containing mixture derived from hydrocarbon pyrolysis, wherein at least 70 wt. % of the mixture has a normal boiling point of at least 290° C., and combining the first pyrolysis tar with a predetermined amount of the second pyrolysis tar to produce a pyrolysis tar composition, (B) (I) isolating a sample from the pyrolysis tar composition, (II) producing additional free radicals in the pyrolysis tar composition sample by exposing the pyrolysis tar composition sample to a temperature of at least $T_2$ for time of at least $t_h$, and (III) cooling the pyrolysis tar composition sample to a temperature $\leq T_3$, the cooled pyrolysis tar composition sample having a total free radical content $R_T$, and (C) when $R_T$ does not exceed $R_{ref}$, either (I) conducting the pyrolysis tar composition to step (e) or (II) further increasing the amount of second pyrolysis tar in the pyrolysis tar composition and then repeating steps (d)(ii)(B) and (C); and when $R_T$ exceeds $R_{ref}$, increasing the amount of the second pyrolysis tar in the pyrolysis tar composition and then repeating steps (d)(ii)(B) and (C); and (e) hydroprocessing at least a portion of the pyrolysis tar of step (d)(i) and/or the pyrolysis tar composition of step d (ii) to produce a hydroprocessed pyrolysis tar.

2. A hydrocarbon conversion process using at least first and second pyrolysis tars, each pyrolysis tar being a hydrocarbon-containing mixture derived from hydrocarbon pyrolysis, wherein at least 70 wt. % of the mixture has a normal boiling point of at least 290° C. and the mixture includes free radicals, the process comprising:

(a) providing a pyrolysis tar composition at a temperature $T_1\leq350°$ C., the pyrolysis tar composition having an initial blend ratio (wt. % second pyrolysis tar in blend): (wt. % first pyrolysis tar in blend) equal to zero;

(b) isolating a sample from the pyrolysis tar composition and producing additional free radicals in the sample by exposing the sample to a predetermined second temperature $T_2$ for a predetermined time $t_h$, wherein $T_2\geq T_1+10°$ C.;

(c) cooling the sample to a temperature $T_3$, $T_3$ being $\leq T_1$, the cooled sample having a total free radical content $R_T$;

(d) (i) when $R_T$ does not exceed a predetermined reference free radical content $R_{ref}$, conducting the pyrolysis tar composition to step (e), and (ii) when $R_T$ exceeds $R_{ref}$, (A) increasing the blend ratio of the pyrolysis tar composition and repeating steps (a), (b) and (c) until at least achieving a second blend ratio wherein $R_T$ does not exceed $R_{ref}$, and (B) conducting the pyrolysis tar composition to step (e); and (e) hydroprocessing at least a portion of the pyrolysis tar composition of step (d)(i) and/or step d(ii) to produce a hydroprocessed pyrolysis tar.

3. The process of claim 1, wherein $R_T$, and $R_{ref}$ are determined by electron spin resonance, $R_{ref}=2\times10^{18}$ spins per gram, $T_2\geq440°$ C., $t_h\geq120$ seconds, ≥90 wt. % of the first pyrolysis tar has a normal boiling point ≥290° C., the first pyrolysis tar has a viscosity at 15° C.≥$1\times10^4$ cSt, and the first pyrolysis tar has a density ≥1.1 g/cm$^3$.

4. The process of claim 1, wherein ≥90 wt. % of the second pyrolysis tar has a normal boiling point ≥290° C., the second pyrolysis tar having a viscosity at 15° C.≥$1\times10^4$ cSt and a density ≥1.1 g/cm$^3$.

5. The process of claim 1, wherein (i) the first pyrolysis tar has an $S_{BN}>135$ and an $I_N>80$, and (ii) the pyrolysis tar composition has an $S_{BN}$ that is at least 20 solvency units greater than the $I_N$ of the pyrolysis tar composition.

6. The process of claim 1, wherein the hydroprocessed tar has a density measured at 15° C. that is at least 0.12 g/cm$^3$ less than smaller of (i) the density measured at 15° C. of the first pyrolysis tar and (ii) the density measured at 15° C. of the second pyrolysis tar.

7. The process of claim 1, further comprising carrying out the hydroprocessing in the presence of a utility fluid having an ASTM D86 10% distillation point ≥60° C. and a 90% distillation point ≤425° C., wherein the utility fluid comprises aromatic hydrocarbon.

8. The process of claim 7, wherein the utility fluid has a $S_{BN}\geq100$.

9. The process of claim 1, wherein the hydroprocessing is carried out in at least one hydroprocessing zone operating under hydroprocessing conditions in the presence of at least one catalyst and a treatment gas comprising molecular hydrogen to produce a hydroprocessor effluent comprising the hydroprocessed pyrolysis tar, wherein the hydroprocessing conditions include a temperature ≥200° C., a pressure ≥8 MPa and a weight hourly space velocity of the feed mixture that is ≥0.3 hr$^1$.

10. The process of claim 1, wherein the hydroprocessing conditions include a molecular hydrogen consumption rate in the range of 270 standard cubic meters of molecular hydrogen per cubic meter of (the first pyrolysis tar+the second pyrolysis tar) in the feed (S m$^3$/m$^3$) to 534 S m$^3$/m$^3$.

11. The process of claim 1, further comprising:

(f) separating from the hydroprocessed effluent (i) a primarily vapor-phase first stream comprising at least a portion of any unreacted molecular hydrogen, (ii) a primarily liquid-phase second stream comprising at least a portion of the hydroprocessed tar, and (iii) a primarily liquid-phase third stream comprising at least a portion of any unreacted utility fluid; and (g) recycling to the hydroprocessing of step (e) at least a portion of the first stream and/or at least a portion of the third stream.

12. The process of claim 1, wherein the hydroprocessing of step (e) exhibits a 566° C.+ conversion of at least 20 wt. % substantially continuously for at least ten days.

13. A pyrolysis tar upgrading process, comprising:

(a) providing a pyrolysis tar having a temperature $T_1\leq350°$ C., the pyrolysis tar being a hydrocarbon-containing mixture containing free radicals and being derived from hydrocarbon pyrolysis, wherein at least 70 wt. % of the mixture has a normal boiling point of at least 290° C.;

(b) isolating a sample from the pyrolysis tar product and producing additional free radicals in the sample by exposing the sample to a predetermined second temperature $T_2$ for a predetermined time $t_h$, wherein $T_2\geq T_1+10°$ C.;

(c) cooling the sample to a temperature $T_3$, $T_3$ being $\leq T_1$, the cooled sample having a total free radical content $R_T$;

(d) producing a feed by combining at least a portion of the pyrolysis tar with a utility fluid having an ASTM D86 10% distillation point ≥60° C. and a 90% distillation point ≤425° C., wherein the utility fluid comprises aromatic hydrocarbon; and (e) hydroprocessing the feed in at least one hydroprocessing zone under hydroprocessing conditions in the presence of at least one catalyst and a treatment gas comprising molecular hydrogen to produce a hydroprocessor effluent comprising hydroprocessed pyrolysis tar, wherein:

(i) when $R_T$ does not exceed a predetermined reference free radical content $R_{ref}$, the hydroprocessing conditions include a first hydroprocessing temperature $T_a\geq200°$ C., a pressure ≥8 MPa, a first weight hourly space velocity of the feed mixture $WHSV_a$ that is ≥0.3 hr$^{-1}$, and a molecular hydrogen consumption rate in the range of from 270 standard cubic meters of molecular hydrogen per cubic meter of the pyrolysis tar in the feed (S m$^3$/m$^3$) to about 534 S m$^3$/m$^3$ (1520 SCF/B to 3000 SCF/B), and (ii) when $R_T$ exceeds $R_{ref}$, the hydroprocessing conditions include a second hydroprocessing temperature $T_b\geq T_a-10°$ C., a pressure ≥8 MPa, a second weight hourly space velocity of the feed mixture $WHSV_b$ that is $\geq WHSV_a+0.01$ hr$^{-1}$, and a molecular hydrogen consumption rate in the range of from 150 standard cubic meters of molecular hydrogen per cubic meter of the pyrolysis tar in the feed (S m$^3$/m$^3$) to about 400 S m$^3$/m$^3$ (845 SCF/B to 2250 SCF/B).

14. The process of claim 13 wherein $R_T$, and $R_{ref}$ are determined by electron spin resonance, $R_{ref}=2\times10^{18}$ spins per gram, $T_2\geq440°$ C., $t_h\geq120$ seconds, $T_b$ is ≤400° C.

15. The process of claim 13, wherein the utility fluid has a true boiling point distribution having (i) an initial boiling point ≥130° C. and (ii) a final boiling point ≤566° C.

16. The process of claim 13, wherein the pyrolysis tar includes at least one steam cracker tar.

17. The process of claim 13, wherein the viscosity of the hydroprocessed tar measured at 50° C. is ≤200 cSt.

18. The process of claim 13, wherein the utility fluid comprises ≥15 wt. % of two ring and/or three ring aromatic compounds.

19. The process of claim 13, wherein $WHSV_b$ is ≥1 hr$^{-1}$ and wherein the hydroprocessing of step (e) (ii) exhibits a 566° C.+ conversion of at least 20 wt. % substantially continuously for at least ten days.

20. The process of claim 13, where the hydroprocessed tar has a density measured at 15° C. that is at least 0.10 g/cm$^3$ less than the density of the first pyrolysis tar.

21. The process of claim 13, wherein the pyrolysis tar has $I_N>80$ and >70 wt. % of the pyrolysis tar's molecules have an atmospheric boiling point of ≥290° C.

22. A method for producing a hydroprocessed steam cracker tar, the process comprising:

(a) providing a first steam cracker tar having a temperature $T_1\leq350°$ C., the steam cracker tar having a density at 15° C.≥1.10 g/cm$^3$ and viscosity at 50° C.≥1000 cSt, wherein (i) at least 70 wt. % of the steam cracker tar has a normal boiling point of at least 290° C., and (ii) the steam cracker tar includes free radicals;

(b) isolating a sample from the steam cracker tar and producing additional free radicals in the sample by exposing the sample to a predetermined second temperature $T_2$ for a predetermined time $t_h$, wherein $T_2 \geq T_1 + 10°$ C.;

(c) cooling the sample to a temperature $T_3$, $T_3$ being $\leq T_1$, the cooled sample having a total free radical content $R_T$;

(d) (i) when $R_T$ does not exceed a predetermined reference free radical content $R_{ref}$, conducting the first steam cracker tar to step (e), (ii) when $R_T$ exceeds $R_{ref}$, (A) providing a second pyrolysis tar at a temperature $\leq T_1$, the second pyrolysis tar, wherein (I) the second pyrolysis tar has fewer free radicals than the steam cracker tar, (II) is a hydrocarbon-containing mixture derived from hydrocarbon pyrolysis, and (III) at least 70 wt. % of the mixture has a normal boiling point of at least 290° C.; and further comprising combining the steam cracker tar with a predetermined amount of the second pyrolysis tar to produce a pyrolysis tar composition, (B) (I) isolating a sample from the pyrolysis tar composition, (II) producing additional free radicals in the pyrolysis tar composition sample by exposing the pyrolysis tar composition sample to a temperature of at least $T_2$ for time of at least $t_h$, and (III) cooling the pyrolysis tar composition sample to a temperature $\leq T_3$, the cooled pyrolysis tar composition sample having a total free radical content $R_T$, and (C) when $R_T$ does not exceed $R_{ref}$, either (I) conducting the pyrolysis tar composition to step (e) or (II) further increasing the amount of second pyrolysis tar in the pyrolysis tar composition and then repeating steps (d)(ii)(B) and (C); and when $R_T$ exceeds $R_{ref}$, increasing the amount of the second pyrolysis tar in the pyrolysis tar composition and then repeating steps (d)(ii)(B) and (C), (e) producing a feed by combining with a utility fluid at least a portion of the steam cracker tar of step (d)(i) and/or at least a portion of the pyrolysis tar composition of step (d)(ii), the utility fluid having an ASTM D86 10% distillation point ≥60° C. and a 90% distillation point ≤425° C., wherein the utility fluid comprises aromatic hydrocarbon; and (f) hydroprocessing the feed in at least one hydroprocessing zone under hydroprocessing conditions in the presence of at least one catalyst and a treatment gas comprising molecular hydrogen to produce a hydroprocessor effluent comprising hydroprocessed steam cracker tar, wherein the hydroprocessing conditions include a temperature ≥200° C., a pressure ≥8 MPa, a weight hourly space velocity of the feed mixture that is ≥0.3 $hr^1$, and a molecular hydrogen consumption rate in the range of from 270 standard cubic meters of molecular hydrogen per cubic meter of (the steam cracker tar+the second pyrolysis tar) in the feed (S $m^3/m^3$) to about 534 S $m^3/m^3$ (1520 SCF/B to 3000 SCF/B).

23. The process of claim 22, wherein the second pyrolysis tar is a steam cracker tar, $R_T$ and $R_{ref}$ are determined by electron spin resonance, $R_{ref}=2\times10^{18}$ spins per gram, $T_2 \geq 440°$ C., and $t_h \geq 120$ seconds.

24. The process of claim 22, wherein the utility fluid has a $S_{BN} \geq 100$, and ≥90 wt. % of the first steam cracker tar's molecules have an atmospheric boiling point of ≥290° C.

25. The process of claim 22, wherein the hydroprocessing of step (f) exhibits a 566° C.+conversion of at least 20 wt. % substantially continuously for at least ten days.

* * * * *